United States Patent [19]

Nakamura et al.

[11] Patent Number: 4,740,153

[45] Date of Patent: Apr. 26, 1988

[54] FIRE-EXTINGUISHING DEVICE FOR OIL BURNER

[75] Inventors: Kazuharu Nakamura, Aichi; Yoshio Mito, Gifu; Yutaka Nakanishi, Aichi, all of Japan

[73] Assignee: Toyotomi Kogyo Co., Ltd., Aichi, Japan

[21] Appl. No.: 864,984

[22] Filed: May 20, 1986

[30] Foreign Application Priority Data

May 21, 1985 [JP] Japan ..... 60-75468[U]

[51] Int. Cl.[4] ..... F23N 5/24

[52] U.S. Cl. ..... 431/33; 431/88; 126/96

[58] Field of Search ..... 431/33, 34, 88; 126/96, 126/92 AC

[56] References Cited

U.S. PATENT DOCUMENTS

| | | | |
|---|---|---|---|
| 4,486,170 | 12/1984 | Tsukuda et al. | 431/315 |
| 4,492,218 | 1/1985 | Uchida et al. | 126/96 |
| 4,498,862 | 12/1985 | Nakamura et al. | 431/88 |
| 4,591,000 | 5/1986 | Nakamura et al. | 169/54 |

FOREIGN PATENT DOCUMENTS

| | | | |
|---|---|---|---|
| 55-68519 | 5/1980 | Japan | 126/96 |
| 55-68520 | 5/1980 | Japan | 126/96 |

*Primary Examiner*—Randall L. Green
*Assistant Examiner*—Allen J. Flanigan
*Attorney, Agent, or Firm*—Pollock, Vande Sande & Priddy

[57] ABSTRACT

A fire-extinguishing device for a wick ignition type oil burner adapted to discharge combustion gas to a room is disclosed which is capable of effectively removing bad odor generating materials contained in combustion gas produced during the fire-extinguishing operation to prevent the discharge of bad odor to a room. The fire-extinguishing device includes an actuation mechanism actuated with a wick actuating mechanism of an oil burner at the fire-extinguishing operation to lift a combustion cylinder construction of the oil burner and a combustion gas clarification mechanism which carries a catalyst thereon and is adapted to sealedly fit an upper portion of the lifted combustion cylinder construction therein so that combustion gas produced during the fire-extinguishing operation may be passed through the catalyst to remove, from the combustion gas, bad odor generating materials contained therein.

15 Claims, 3 Drawing Sheets

FIRE-EXTINGUISHING DEVICE FOR OIL BURNER

BACKGROUND OF THE INVENTION

1. Field of the Invention

This invention relates to a fire-extinguishing device for an oil burner, and more particularly to a fire-extinguishing device for a wick ignition type oil burner which is adapted to discharge exhaust gas or combustion gas to a room.

2. Description of the Prior Art

Conventionally, an open-type oil burner or an oil burner of the type discharging exhaust gas or combustion gas directly to a room has an important disadvantage of discharging bad odor to a room during the fire-extinguishing operation, although the generation of bad odor during the combustion operation is substantially prevented. This is due to the fact that the cooling of a combustion cylinder construction and a wick receiving cylinder of the oil burner to room temperature after the fire-extinguishing requires a relatively long period of time, so that fuel oil gas and incomplete combustion gas which cause bad odor may be vaporized from a wick and produced in the combustion cylinder construction, respectively. The generation of such bad odor is observed particularly during the instantaneous fire-extinguishing operation of the oil burner which is carried out through a vibration sensing weight or a manual operating handle in an emergency such as earthquake, although it is produced also during the normal fire-extinguishing through the manual operation of a wick operating shaft.

For the purpose of preventing the bad odor from discharging to a room, a catalyst means is often used to oxidize the fuel oil gas and incomplete combustion gas to effect deodorization. Nevertheless, such a countermeasure fails to effectively prevent bad odor from being discharged to a room.

SUMMARY OF THE INVENTION

Generally speaking, in accordance with the present invention, a fire-extinguishing device for a wick ignition type oil burner which is adapted to discharge combustion gas through a top of a combustion cylinder construction to a room is provided. The fire-extinguishing device includes a combustion gas clarification means arranged upwardly apart from the top of the combustion cylinder construction with a predetermined gap being defined therebetween. The combustion gas clarification means carries thereon a catalyst which effects deodorization of combustion gas produced in the combustion cylinder construction or acts to remove bad odor generating materials from the combustion gas. The fire-extinguishing device also includes an actuation mechanism for upwardly moving the combustion cylinder construction by a distance corresponding to the gap at the fire-extinguishing of the oil burner to sealedly fit at least the top of the combustion cylinder construction in a lower portion of the combustion gas clarification means. The combustion gas clarification means is adapted to pass gas in the oil burner including combustion gas only through the catalyst during the fire-extinguishing to clarify the combustion gas by means of the catalyst, to thereby prevent the discharge or diffusion of bad odor gas to a room.

Accordingly, it is an object of the present invention to provide a fire-extinguishing device for a wick ignition type oil burner which is capable of effectively preventing bad odor generated during the fire-extinguishing of the oil burner from being discharged to the exterior of the oil burner.

It is another object of the present invention to provide a fire-extinguishing device for a wick ignition type oil burner adapted to discharge combustion gas to a room which is capable of effectively preventing bad odor generated during the instantaneous fire-extinguishing of the oil burner from being discharged to a room.

It is a further object of the present invention to provide a fire-extinguishing device for a wick ignition type oil burner adapted to discharge combustion gas to a room which is constructed to be operated with a wick actuating mechanism of the oil burner to prevent bad odor generated during the instantaneous fire-extinguishing operation of the oil burner from being discharged to a room.

It is still another object of the present invention to provide a fire-extinguishing device for a wick ignition type oil burner adapted to discharge combustion gas to a room which is capable of significantly decreasing the generation of fuel oil gas causing bad odor during the fire-extinguishing operation of the oil burner.

It is yet another object of the present invention is to provide a fire-extinguishing device for a wick-ignition type oil burner adapted to discharge combustion gas to a room which is capable of accomplishing the above-described objects with a simple construction.

It is still a further object of the present invention to provide a fire-extinguishing device for a wick ignition type oil burner adapted to discharge combustion gas to a room which is capable of exhibiting excellent reliability and durability.

Still other objects and advantages of the present invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Now, a fire-extinguishing device for an oil burner according to the present invention will be described hereinafter with reference to the accompanying drawings.

Figure 1:
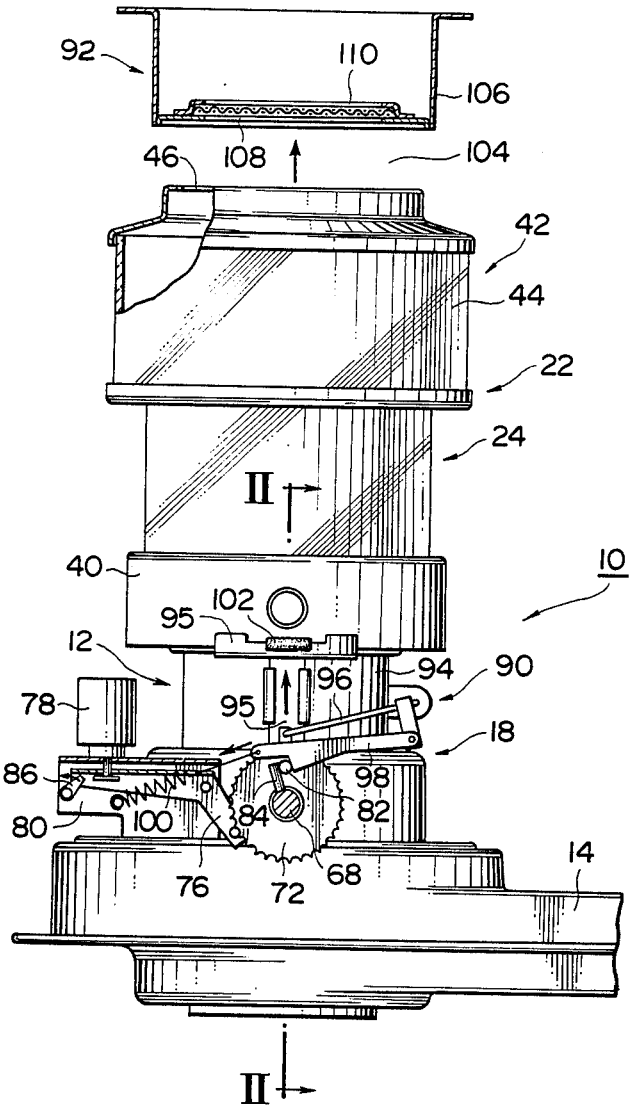
FIG. 1 is a schematic front view partly in section showing an essential part of an example of an oil burner in which a fire-extinguishing device according to the present invention is adapted to be incorporated.
Figure 2:
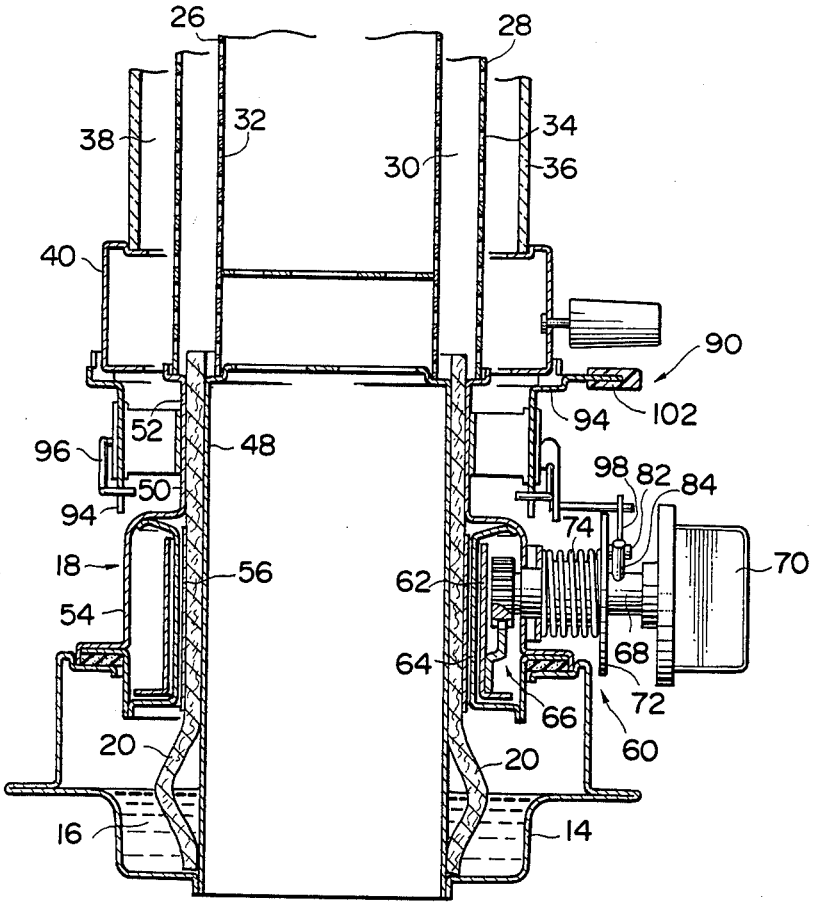
FIG. 2 is a vertical sectional view taken along line II—II of FIG. 1.

Referring now to FIGS. 1 and 2, there is schematically illustrated an essential part of an oil burner which is generally designated by reference numeral 10 and adapted to incorporate therein a fire-extinguishing device according to the present invention. In FIGS. 1 and 2, a fire-extinguishing device of the present invention is generally indicated by reference numeral 12. The oil burner illustrated in FIG. 1 is a wick-ignition type oil-fired space heater which is adapted to discharge exhaust gas or combustion gas of a high temperature to a room to be heated. However, it should be noted that an oil burner in which the fire-extinguishing device of the present invention is to be incorporated is not limited to an oil-fired space heater.

The oil burner 10 shown in FIGS. 1 and 2 is constructed in such a manner as widely known in the art, except the fire-extinguishing device 12 of the present invention. The oil burner 10 includes an oil reservoir 14 for storing fuel oil 16 such as kerosene therein, on which an oil tank (not shown) is supported in a manner to be fluidly communicated thereto. The oil burner 10 also includes a wick receiving cylinder 18 arranged on the oil reservoir 14 and communicated thereto, so that a substantial portion of a wick 20 may be received in the wick receiving cylinder 18 and a lower portion of the wick is dipped in the fuel oil 14.

Also, the oil burner 10 includes a combustion cylinder construction 22 vertically movably arranged on the wick receiving cylinder 22 so that it may be vertically moved by the fire-extinguishing device 12 of the present invention in such a manner as detailedly described hereinafter. The combustion cylinder construction 22 includes a multi-cylinder combustion means 24, which comprises an inner cylindrical member 26 and an outer cylindrical member 28 which are arranged substantially concentrically with each other to define a space 30 therebetween, as shown in FIG. 2. The inner and outer cylindrical members 26 and 28 are provided with a plurality of through-holes 32 and 34, respectively. The multi-cylinder combustion means 24 further comprises a heat-permeable cylinder 36 formed of, for example, a transparent glass material such as glass or the like and arranged at an outside of the outer cylindrical member 28 so that a space 38 may be defined between the heat-permeable cylinder 36 and the outer cylindrical member 28. The heat-permeable cylinder 36 is supported through a non-permeable cylinder 40 on the wick receiving cylinder 18. In the illustrated embodiment, the heat-permeable cylinder 36 and non-permeable cylinder 40 are vertically moved together with the inner and outer cylindrical members 26 and 28 by means of the fire-extinguishing device 12 in a manner described hereinafter.

In the multi-cylinder combustion means 24 constructed as described above, fuel oil vaporized from an upper portion of the wick 20 which is upwardly moved to a lower portion of the space 30 in a manner described below is burned to red-heat the inner and outer cylindrical members 26 and 28, to thereby emit heat rays from the so red-heated cylindrical members. The heat rays are then discharged through the heat-permeable cylinder 36 to a room.

The combustion cylinder construction 22 also includes a flame spreading means 42 securely mounted on the multi-cylinder combustion means 24 in a manner to be communicated thereto. The flame spreading means 42 comprises a heat-permeable cylinder 44 formed of, for example, a semi-transparent glass material and a flame spreader (not shown) arranged in the cylinder 44 and is adapted to completely burn unburned fuel oil gas and/or incomplete combustion gas contained in combustion gas generated in the multi-cylinder combustion means 24 to form a white yellow flame. Heat rays emitted from the so-formed flame are discharged through the heat-permeable cylinder 44 to a room.

Combustion gas of a high temperature produced in the multi-cylinder combustion means 24 and flame spreading means 42 is discharged through an opening 46 formed at a top end of the flame spreading means 42 to a room. Thus, it will be noted that the oil burner 10 shown in FIGS. 1 and 2 is adapted to heat a room by both heat rays emitted from the combustion cylinder construction 22 and combustion gas of a high temperature discharged therefrom.

The wick receiving cylinder 18 may be constructed in such a conventional manner as taught in U.S. Pat. No. 4,363,620 issued to Nakamura et al on Dec. 14, 1982. More particularly, the wick receiving cylinder 18, as shown in FIG. 2, includes an inner wall 48 and an outer wall 50 which define therebetween an annular chamber for receiving the wick 20, which is communicated to the oil reservoir 14 and the space 30. When ignition and then combustion are to be carried out, the wick 20 is raised to the lower portion of the space 30 as shown in FIG. 2 in a manner described hereinafter. The outer wall 50 is formed to have an upper reduced wall portion and a lower expanded portion so that the wick receiving cylinder may be divided into an upper reduced section 52 and a lower expanded section 54 communicated to each other. The wick 20 is supported on an annular retaining plate 56 which is disposed in the lower expanded section 54 of the wick receiving cylinder 18.

Reference numeral 60 designates a wick actuating mechanism for vertically moving the wick 20 through the wick retaining plate 56. In the example of the oil burner shown in FIGS. 1 and 2, the wick actuating mechanism 60 is arranged at the lower expanded section 54 of the wick receiving cylinder 18. The wick actuating mechanism 60 may be constructed in such a conventional manner as widely known in the art. The wick actuating mechanism 60 includes an annular plate 62 which is provided at an outside of an intermediate wall member 64 of the wick receiving cylinder 18 arranged in the lower expanded section 54 so that it may be circumferentially moved by means of a pinion-rack means 66 provided at an inner end of a wick operating shaft 68. The connection between the wick retaining plate 56 and the actuating plate 62 may be carried out in a conventional manner, for example, through an oblique slot (not shown) formed at the intermediate wall member 64 by means of a connecting pin (not shown). The wick operating shaft 68 is also provided at an outer end thereof with a knob 70 through which the shaft 68 is rotated.

The wick actuating mechanism 60 also includes a gear 72 freely fitted on the wick operating shaft 68, a coiled spring or return spring 74 fitted on the shaft 68 and fixedly interposed between the gear 72 and a burner body, and a pivoted stopper 76 (FIG. 1) which acts to engage at one end thereof with the gear 72 to stop rotation of the gear 72 and is constantly forced at the one end thereof against the gear 74 by spring means (not shown). The stopper 76 is connected at the other end thereof to a vibration sensing weight 78 arranged on a horizontal support 80 so that the stopper 76 may be upwardly moved at the other end by the weight 82 when it is vigorously vibrated or tilted. As a result, the stopper 76 is disengaged from the gear 76.

The gear 72 has a rod 82 mounted thereon, which is provided so as to axially extend from the gear 72 toward the knob 70. The wick operating shaft 68 is provided with a radially outwardly extending pin member 84. The pin member 84 serves to force the rod member 82 to rotate the gear 72 with the wick operating shaft 68 to wind the spring 74, when the shaft 68 is rotated in the direction to move the wick 20 upwardly. When the spring 74 is wound up, the stopper 76 engages with the gear 72 to prevent the gear from being reversed due to the wound spring, to thereby keep the spring in a wound state.

The wick actuating mechanism 60 further includes a manual operating means or handle 86 arranged adjacent to the stopper 76 as shown in FIG. 1, which serves to operate the stopper 76 to release the engagement between the gear 72 and the stopper 76 as desired when the vibration sensing weight 78 is not actuated or any other emergency occurs.

Figure 3:
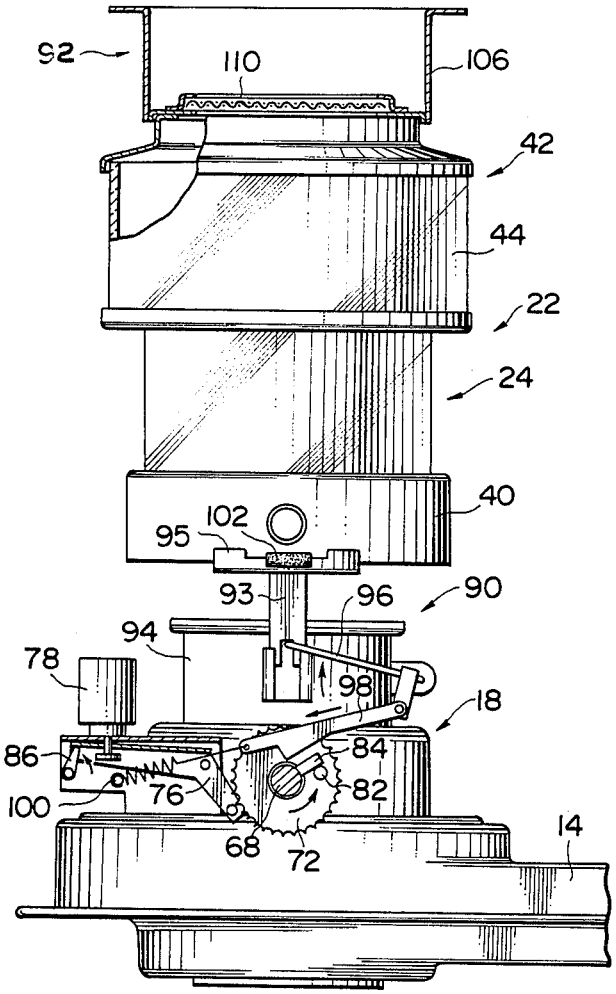
FIG. 3 is a schematic front view similar to FIG. 1 showing the manner of operation of a fire-extinguishing device of the present invention.

Now, the manner of operation of the wick actuating mechanism 60 will be described hereinafter with reference to FIGS. 1 to 3.

When the rotation of the wick operating shaft 68 in the direction of upwardly moving the wick 20 or in the clockwise direction in FIG. 1 is started in a state that the wick is at a fire-extinguishing position or a lowermost position and the spring is unwound, the pin member 84 of the wick operating shaft 68 is pressedly abutted against the rod member 82 of the gear to start the rotation of the gear and the upward movement of the wick 20 is started through the pinion-rack means 66. Then, when the wick operating shaft 68 is further rotated, the return spring 74 is wound up due to the rotation of the gear 72 while keeping the contact between the pin member 84 and the rod member 82 and the wick 20 may be upwardly moved to an uppermost position or ignition-combustion position. Thus, the wick actuating mechanism 60 and wick 20 are caused to be positioned as shown in FIGS. 1 and 2.

The manual fire-extinguishing operation is carried out by rotating the wick operating shaft 68 in the direction of lowering the wick 20 or in the counterclockwise direction in FIG. 1. This is carried out while the spring 74 is wound up, because the gear is kept in a state being engaged with the stopper.

When an emergency such as earthquake or the like sufficient to actuate the vibration sensing weight 78 occurs or the manual operating handle 86 is actuated by an operator due to any other emergency, the gear 72 is disengaged from the stopper 76 at the position shown in FIG. 1 and rotated in the counterclockwise direction in FIG. 1 to release the wound spring 74. This causes the rod member 82 to forcedly press the pin member 84 in the counterclockwise direction in FIG. 1, resulting in the wick operating shaft 68 being rotated in the counterclockwise direction while keeping the contact between the rod member 82 and the pin member 84; so that the wick 20 may be lowered to the lowermost position or fire-extinguishing position and the return spring 74 may be completely unwound. Thus, the wick actuating mechanism 60 is caused to be at such a position as shown in FIG. 3.

Now, the fire-extinguishing device 10 will be described hereinafter with reference to the drawings.

The fire-extinguishing device 10 of the illustrated embodiment comprises a portion arranged at a periphery of the upper reduced section 52 of the wick receiving cylinder 18 and a portion arranged above the combustion cylinder construction 22. More particularly, the fire-extinguishing device comprises an actuation mechanism which is generally designated by reference numeral 90 and adapted to vertically move the combustion cylinder construction 22 and a combustion gas clarification means which is generally designated by reference numeral 92 and arranged above the combustion cylinder construction 22.

In the fire-extinguishing device 10 of the illustrated embodiment, the actuation mechanism 90 is constructed to be operated with the wick actuating mechanism 60 described above for the purpose of simplifying the structure of the oil burner. However, it is a matter of course that the actuation mechanism 90 may be provided so as to be independent in operation from the wick operating mechanism 60. Also, the following description on the fire-extinguishing device 10 will be made in relation to the instantaneous fire-extinguishing operation of the oil burner carried out through the vibration sensing weight 78 or manual operating handle 86, however, the fire-extinguishing device of the present invention is of course applicable to the normal manual fire-extinguishing operation through the wick operating shaft.

The actuation mechanism 90 includes a lift means for lifting the combustion cylinder construction 22, which is arranged around the upper reduced section 52 of the wick receiving cylinder 18. In the illustrated embodiment, the lift cylinder means comprises a support cylinder 94 arranged to surround the upper reduced section 52, a vertically movable or slidable member 93 movably mounted on the support cylinder 94 and having an upper end fixedly connected to a connection member 95 mcunted on the lower portion of the combustion cylinder construction 22. The actuation mechanism 90 also includes a lever 96 pivotally connected at one end thereof to a lower portion of the vertically movable member 93, an engagement means 98 pivotally connected at one end thereof to the other end of the lift lever 96 and engaged with the rod member 82 of the gear 72 only when the gear 72 is engaged with the stopper 76 to keep the return spring 74 at a wound state, and a bias means 100 mounted at one end thereof on the horizontal support 80 and connected at the other end thereof to the other end of the engagement means 98 so as to constantly bias the engagement means 98 toward the rod member 82. In the illustrated embodiment, the engagement means 98 comprises a holding plate member and a bias means 100 comprises a compression spring or coiled spring. As described above, the holding plate member 98 is adapted to be engaged with the rod member 82 when the gear 72 is engaged with the stopper 76, accordingly, it will be noted that, in the illustrated embodiment, the actuation mechanism 90 is kept stationary when the manual fire-extinguishing operation is carried through the manual rotation of the wick operating shaft 68. Thus, in the actuation mechanism 90, when the vibration sensing weight 78 is actuated or the manual operating handle 86 is operated to release the engagement between the stopper 76 and the gear 72, the holding plate member 98 is disengaged from the rod member 82 because the rod member is rotated with the gear in the counterclockwise direction in FIG. 1. This causes the coiled spring 74 to pull the plate member 98 to pivotally move the lift lever about the one end of the plate member in the clockwise direction in FIG. 1, so that the lift cylinder 94 may be upwardly moved to lift the combustion cylinder construction 22, as shown in FIG. 3.

Reference numeral 102 designates an operation knob mounted on the vertically movable member 93 which serves to lower, to the wick receiving cylinder 18, the combustion cylinder construction 22 lifted due to the operation of the vibration sensing weight 78 or manual operating handle 86, after the wick operating shaft 68 is rotated to raise the wick 20 and wind up the return spring 74 again.

The combustion gas clarification means 92, as described above, is arranged above the combustion cylinder construction through a predetermined gap indicated by reference numeral 104 in FIG. 1. The gap 104 is determined to correspond to a vertical stroke of the lever 96 or the amount of upward movement of the combustion cylinder construction 22 by the actuation mechanism 90. In the illustrated embodiment, the combustion gas clarification means 92 comprises a cylinder 106 formed at a lower end thereof with an opening 108 and a catalyst 110 supportedly disposed in the opening 106. In the illustrated embodiment, a clarification or deodorization catalyst for clarifying unburned fuel oil gas and incomplete combustion gas, for example, such as an oxidation catalyst may be used as the catalyst 110. The cylinder 106 has a lower portion formed into a shape sufficient to allow at least an upper opened end portion of the combustion cylinder construction 22 to be tightly fitted therein. Thus, when the actuation mechanism 90 is operated to lift the combustion cylinder construction 22, the construction 22 is fitted in the gas clarification means 92 to cause combustion gas produced in the construction 22 to pass through the oxidation catalyst 110.

In the oil burner in which the fire-extinguishing device of the illustrated embodiment constructed as described above is incorporated, when the instantaneous fire-extinguishing operation is carried out due to the actuation of the vibration sensing weight or manual operating handle 86, the wick actuating mechanism 60 is operated to lower the wick 20 to the fire-extinguishing position and the fire-extinguishing device 10 is actuated to lift the combustion cylinder construction 22 to fit the upper portion of the combustion cylinder construction 22 in the lower portion of the gas clarification means 92; so that combustion gas which is produced during the instantaneous fire-extinguishing and contains a significant amount of incomplete combustion gas and unburned fuel oil gas may be caused to forcibly pass through the catalyst 110, during which the catalyst 110 is heated to a high temperature due to the passing of the combustion gas of a high temperature therethrough, so that it may be kept active sufficiently to clarify the combustion gas. Concurrently, the wick receiving cylinder 18 is rapidly cooled by air in a room because it has been separated from the combustion cylinder construction 22 by means of the actuation mechanism 90, so that fuel oil gas vaporized from the wick may be substantially decreased in amount.

Thus, it will be noted that the fire-extinguishing device can clarify incomplete combustion gas and/or unburned fuel oil gas which are produced at the instantaneous fire-extinguishing operation of the oil burner to prevent the generation of bad odor.

In general, a catalyst having a high clarifying capability exhibits low gas permeability and is rapidly deteriorated in performance at a high temperature. The illustrated embodiment is so constructed that the combustion gas clarification means 92 is positioned upwardly apart from the combustion cylinder construction 22 by the predetermined distance 104 during the combustion operation. Such construction effectively discharges combustion gas of a high temperature through the gap 104 to a room without passing it through the catalyst 110 during the combustion operation, so that the catalyst may be prevented from being deteriorated for a short period of time. Also, this allows combustion gas to be smoothly discharged from the combustion cylinder construction 22 to a room due to the existence of the gap 104 to ensure the stable combustion operation of the oil burner.

As can be seen from the foregoing, the present invention is adapted to lift a combustion cylinder construction of an oil burner to separate a wick receiving cylinder from the combustion cylinder construction at the instantaneous fire-extinguishing operation of the oil burner. This causes the wick receiving cylinder to be rapidly cooled by air in a room, resulting in fuel oil gas vaporized from a wick during the fire-extinguishing being substantially decreased. Also, the present invention is adapted to tightly fit at least the upper end portion of the so-lifted combustion cylinder construction in the lower portion of the combustion gas clarification means to cause combustion gas generated during the fire-extinguishing to forcibly pass through the catalyst carried on the combustion gas clarification means. Thus, it will be noted that the present invention effectively prevents the diffusion of bad odor to a room during the instantaneous fire-extinguishing operation.

The above description has been made in relation to the instantaneous fire-extinguishing operation through the vibration sensing weight or manual operating handle. However, the fire-extinguishing device of the present invention is effectively applicable to the normal fire-extinguishing operation through the wick operating shaft.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A fire-extinguishing device for a wick ignition type oil burner which is adapted to discharge combustion gas through a top of a vertically movable combustion cylinder construction to a room, comprising:

fire-extinguishing means for carrying out a fire-extinguishing operation of said oil burner;

a combustion gas clarification means arranged above said top of said combustion cylinder construction with a predetermined gap being defined therebetween and having a lower portion formed into a shape sufficient to tightly fit at least said top of said combustion cylinder construction; and, an actuation mechanism for upwardly moving said combustion cylinder construction to said combustion gas clarification means through said gap at the fire-extinguishing of said oil burner to carry out the sealed engagement between said combustion gas clarification means and said combustion cylinder construction;

said combustion gas clarification means being adapted to remove bad odor contained in combustion gas produced during the fire-extinguishing operation of said oil burner to prevent the bad odor from being discharged to a room.

2. A fire-extinguishing device as defined in claim 1, wherein said combustion gas clarification means carries thereon a catalyst which effects deodorization of said combustion gas.

3. A fire-extinguishing device as defined in claim 1, wherein said actuation mechanism is operatedly connected to a wick actuating mechanism of said oil burner through which the fire-extinguishing operation of said oil burner is carried out.

4. A fire-extinguishing device as defined in claim 3, wherein said actuation mechanism comprises an engagement means selectively engaged with said wick actuating mechanism of said oil burner, said engagement member being disengaged from said wick actuating mechanism when the fire-extinguishing operation of said oil burner is carried out; and a lift structure operatedly connected between said engagement means and said combustion cylinder construction to lift said combustion cylinder construction when said engagement means is disengaged from said wick actuating mechanism.

5. A fire-extinguishing device as defined in claim 4, wherein said lift structure comprises a lever pivotally connected at one end thereof to said engagement means to be upwardly pivotally moved when said engagement means is disengaged from said wick actuating mechanism; and a lift means connected between said lever and said combustion cylinder construction to lift said combustion cylinder construction when said lever is upwardly pivotally moved.

6. A fire-extinguishing device as defined in claim 5, wherein said lift means comprises a vertically movable member pivotally connected at one end thereof to said lever and fixedly connected at the other end thereof to said combustion cylinder construction.

7. A fire-extinguishing device as defined in claim 6, wherein said vertically movable member is vertically movably supported on a support cylinder fixed on said oil burner.

8. A fire-extinguishing device as defined in claim 5, wherein said engagement means is biased toward said wick actuating mechanism by means of a spring to ensure the engagement between said engagement means and said wick actuating mechanism.

9. A fire-extinguishing device as defined in claim 3, wherein said fire-extinguishing operation is an instantaneous fire-extinguishing operation.

10. A fire-extinguishing device as defined in claim 9, wherein said actuation mechanism comprises:

an engagement means selectively engaged with a connection means of said wick actuating mechanism and disengaged from said connection means when the instantaneous fire-extinguishing operation is carried out, said connection means being adapted to operatedly connect a wick operating shaft and a gear loosely fitted on said wick operating shaft to each other so as to rotate said gear with said wick operating shaft to wind a return spring attached to said gear when said wick operating shaft is rotated to upwardly move a wick and so as to reverse said wick operating shaft when said gear is disengaged, at the time of the instantaneous fire-extinguishing, from a stopper which is engaged with said gear to stop rotation of said gear;

said engagement means being disengaged from said connection means when said stopper is actuated to disengage said gear therefrom at the instantaneous fire-extinguishing; and a lift structure operatedly connected between said engagement means and said combustion cylinder construction to lift said combustion cylinder construction when said engagement means is disengaged from said connection means of said wick actuating mechanism.

11. A fire-extinguishing device as defined in claim 10, wherein said lift structure comprises a lever pivotally connected at one end thereof to said engagement means to be upwardly pivotally moved when said engagement means is disengaged from said connection means of said wick actuating mechanism; and a vertically movable member pivotally connected at one end thereof to said lever and fixedly connected at the other end thereof to said combustion cylinder construction to lift said combustion cylinder construction when said lever is upwardly pivotally moved.

12. A fire-extinguishing device as defined in claim 11, wherein said vertically movable member is vertically movably supported on a support cylinder fixed on said oil burner.

13. A fire-extinguishing device for a wick ignition type oil burner which is adapted to discharge combustion gas through a top of a vertically movable combustion cylinder construction to a room and includes a wick operating mechanism through which the fire-extinguishing operation of said oil burner is carried out, comprising:

a combustion gas clarification means arranged upwardly apart from said top of said combustion cylinder construction with a predetermined gap being defined therebetween and carrying thereon a catalyst which effects the removal of bad odor contained in combustion gas produced during the fire-extinguishing operation of said oil burner to prevent bad odor from being discharged to a room;

said combustion gas clarification means having a lower portion formed into a shape sufficient to tightly fit at least said top of said combustion cylinder construction therein;

an engagement means selectively engaged with said wick actuating mechanism and disengaged from said wick actuating mechanism when the fire-extinguishing operation of said oil burner is carried out; and a lift structure operatedly connected between said engagement means and said combustion cylinder construction to lift said combustion cylinder construction by a distance substantially corresponding to said gap to fit at least said top of said combustion cylinder construction in the lower portion of said combustion gas clarification means when said engagement means is disengaged from said wick actuating mechanism;

whereby combustion gas produced during the fire-extinguishing operation is caused to forcibly pass through said combustion gas clarification means.

14. A fire-extinguishing device for a wick ignition type oil burner which is adapted to discharge combustion gas through a top of a vertically movable combustion cylinder construction to a room and includes a wick actuating mechanism through which the fire-extinguishing operation of said oil burner is carried out, said wick actuating mechanism including a connection means for operably connecting a wick operating shaft and a gear loosely fitted on said wick operating shaft to each other so as to rotate said gear with said wick operating shaft to wind a return spring attached to said gear when said wick operating shaft is rotated to upwardly move a wick and so as to reverse said wick operating shaft when said gear is disengaged, at the instant of fire-extinguishing, from a stopper which is engaged with said gear to stop rotation of said gear except at the instant of fire-extinguishing, comprising:

a combustion gas clarification means arranged upwardly apart from said top of said combustion cylinder construction with a predetermined gap being defined therebetween and carrying thereon a catalyst which effects the removal of bad odor contained in combustion gas produced during the fire-extinguishing operation of said oil burner to prevent bad odor from being discharged to a room;

said combustion gas clarification means having a lower portion formed into a shape sufficient to tightly fit at least said top of said combustion cylinder construction therein;

an engagement means selectively engaged with said connection means of said wick actuating mechanism and disengaged from said connection means when the fire-extinguishing operation of said oil burner is carried out; and a lift structure operatedly connected between said engagement means and said combustion cylinder construction to lift said combustion cylinder construction by a distance substantially corresponding to said gap to fit at least said top of said combustion cylinder construction in the lower portion of said combustion gas clarification means when said engagement means is disengaged from said connection means;

whereby combustion gas produced during the instantaneous fire-extinguishing operation is caused to forcibly pass through said combustion gas clarification means.

15. A fire-extinguishing device for a wick ignition type oil burner which is adapted to discharge combustion gas through a top of a vertically movable combustion cylinder construction to a room and includes a wick actuating mechanism through which the fire-extinguishing operation of said oil burner is carried out, said wick actuating mechanism comprising a wick operating shaft mounted on a burner body of said oil burner and adapted to be rotated to vertically move a wick, a gear loosely fitted on said wick operating shaft and having a return spring connected between said gear and said burner body, a stopper mounted on said burner body and forced by a spring toward said gear to be engaged with said gear, a connection means for operably connecting said wick operating shaft and said gear so as to rotate said gear with said wick operating shaft to wind said return spring when said wick operating shaft is rotated to upwardly move a wick and so as to reverse said wick operating shaft when said gear is disengaged from said stopper, and operation means for operating said stopper in an emergency to disengage said gear from said stopper, comprising:

an engagement means selectively engaged with said connection means of said wick actuating mechanism, said engagement means being disengaged from said said connection means when said stopper is actuated by said operation means;

a spring connected to said engagement means to constantly force said engagement means toward said connection means is of said wick actuating mechanism;

a lever pivotally connected at one end thereof to said engagement means to be upwardly pivotally moved when said engagement means is disengaged from said connection means; and a lift means pivotally connected at one end thereof to said lift lever to be vertically moved and connected at the other end thereof to said combustion cylinder construction, said lift means being vertically upwardly moved by said lever means to lift said combustion cylinder construction when said lever means upwardly pivotally moved due to the disengagement of said engagement means from said connection means.

* * * * *